United States Patent [19]

Albano

[11] Patent Number: 4,620,489

[45] Date of Patent: Nov. 4, 1986

[54] EXTENDIBLE MERCHANDISE SHELVING DISPLAY

[75] Inventor: Vincent J. Albano, Birmingham, Ala.

[73] Assignee: The Kent Corporation, Birmingham, Ala.

[21] Appl. No.: 415,172

[22] Filed: Sep. 7, 1982

[51] Int. Cl.[4] ..... A47B 96/02

[52] U.S. Cl. ..... 108/105; 108/108; 108/143; 211/150; 211/181; 211/198; 403/386

[58] Field of Search ..... 108/102, 105, 137, 143, 108/27, 69, 83, 112, 108, 111; 312/297; 211/151, 150, 162, 164, 198, 181, 153, 184; 403/397, 386, 400

[56] References Cited

U.S. PATENT DOCUMENTS

| | | | |
|---|---|---|---|
| 562,947 | 6/1896 | Bennett et al. | 403/397 |
| 865,305 | 9/1907 | Heim | 403/397 |
| 1,206,730 | 11/1916 | Rideout | 211/153 X |
| 1,244,440 | 10/1917 | Franklin et al. | 211/153 X |
| 1,491,801 | 4/1924 | Holbrook | 248/164 |
| 1,639,387 | 8/1927 | Seward | 108/102 |
| 1,973,416 | 9/1934 | Otte | 108/143 |
| 2,199,981 | 5/1940 | Bell | 108/112 |
| 2,319,470 | 5/1943 | Nobles | 211/153 |
| 2,352,345 | 6/1944 | Rundell | 211/153 |
| 2,414,959 | 1/1947 | Lowe | 108/83 |
| 2,712,917 | 7/1955 | Flora et al. | 403/397 |
| 2,910,188 | 10/1959 | Skolfield et al. | 211/184 |
| 2,980,483 | 4/1961 | Davis | 312/297 X |
| 3,027,016 | 3/1962 | Becht | 211/153 |
| 3,194,528 | 7/1965 | Chesley | 108/108 |
| 3,208,408 | 9/1965 | Maslow | 211/181 X |
| 3,242,885 | 3/1966 | Baker et al. | 108/137 |
| 3,403,789 | 10/1968 | Morte et al. | 211/150 |
| 3,677,203 | 7/1972 | Barrineau | 108/111 |
| 3,993,002 | 11/1976 | Stroh | 108/108 |
| 4,307,671 | 12/1981 | Albano | 108/108 X |

FOREIGN PATENT DOCUMENTS

| | | | |
|---|---|---|---|
| 1036569 | 8/1978 | Canada | 403/400 |
| 2504074 | 8/1976 | Fed. Rep. of Germany | 312/297 |
| 51314 | 3/1922 | Sweden | 211/153 |

*Primary Examiner*—William E. Lyddane
*Assistant Examiner*—Thomas A. Rendos
*Attorney, Agent, or Firm*—Jennings, Carter, Thompson & Veal

[57] ABSTRACT

An extendible merchandise shelving display embodies an elongated, stationary shelf support which extends laterally from and is connected to at least one vertical support. An elongated, movable shelf support extends alongside and is slidably connected to the stationary shelf support. The movable shelf support is adapted for sliding movement relative to the stationary shelf support selectively to an extended position spaced from the vertical support and to a retracted position adjacent the vertical support. Cooperating locking members are carried by the movable and stationary shelf supports in position to engage each other and limit sliding movement of the movable shelf support while in its extended and retracted positions. An extendible shelf embodying a shelf-like member carried by the movable shelf support and at least two movable shelf-like elements carried by the stationary shelf support form a horizontal article supporting surface upon sliding movement of the movable shelf support to its extended position. The movable shelf-like elements pivot to generally upstanding positions adjacent the vertical support upon sliding movement of the movable shelf support to its retracted position.

3 Claims, 14 Drawing Figures

Fig. 12
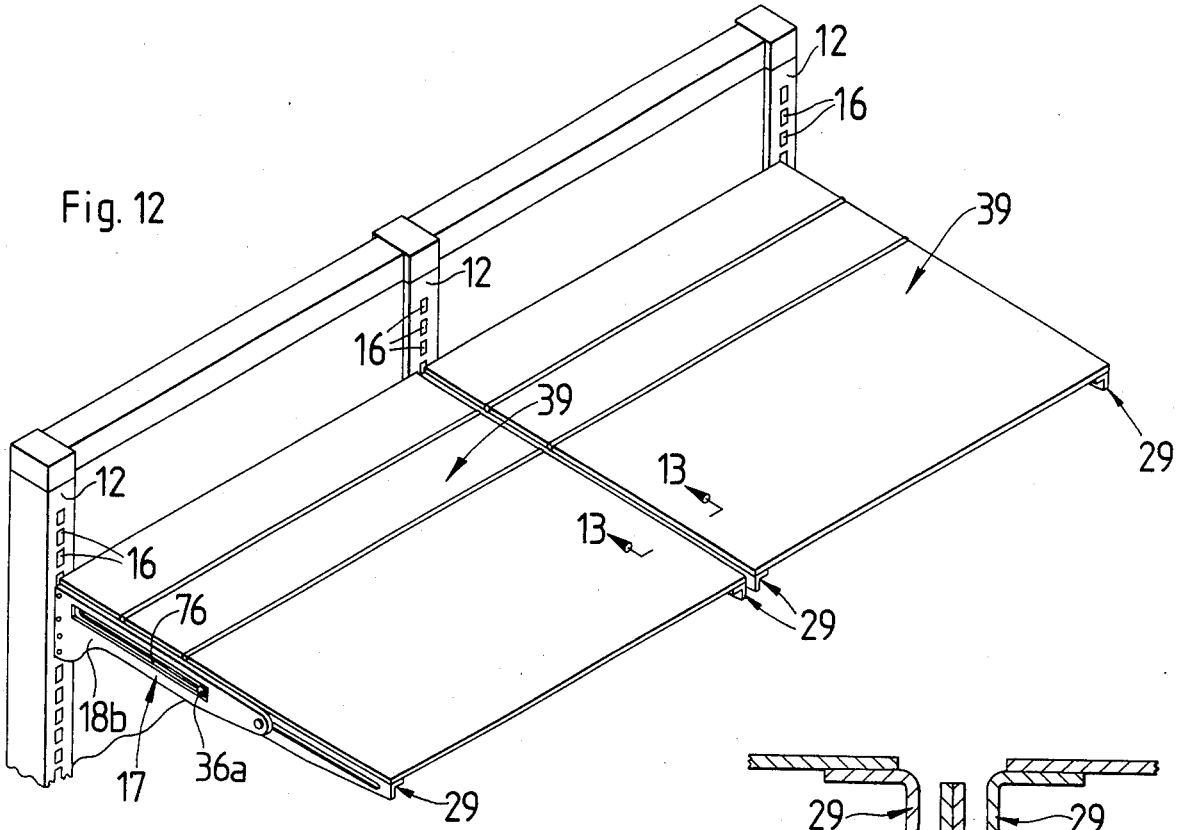
Fig. 10
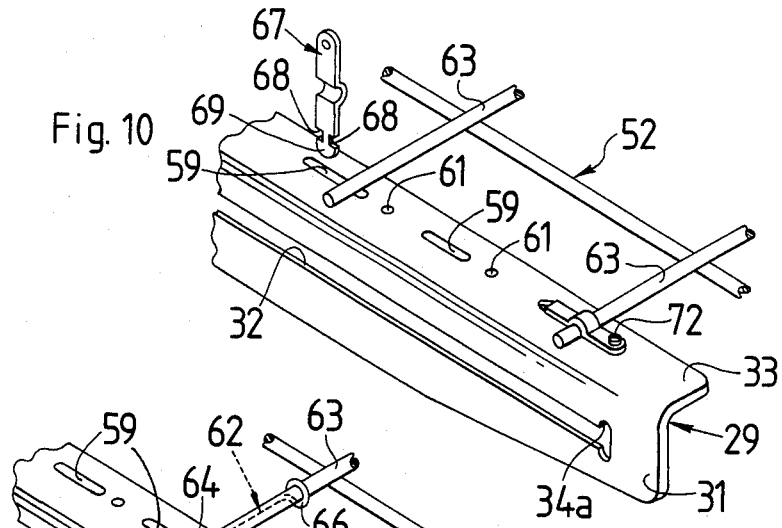
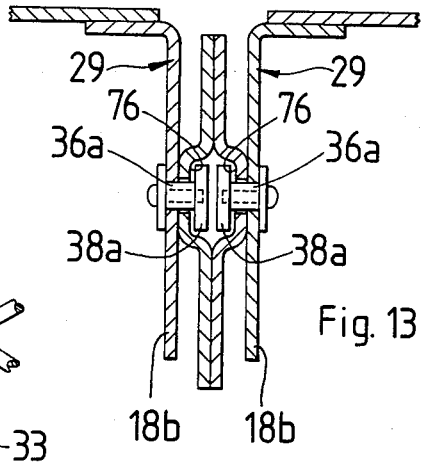
Fig. 13
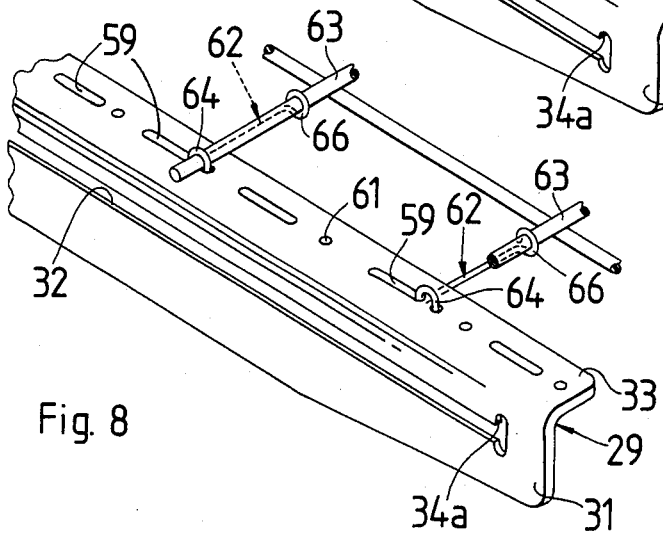
Fig. 8
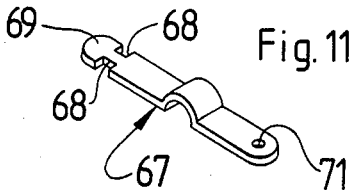
Fig. 11
Fig. 9
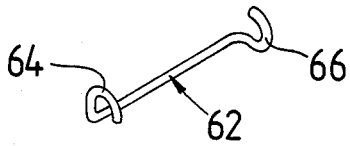

EXTENDIBLE MERCHANDISE SHELVING DISPLAY

BACKGROUND OF THE INVENTION

This invention relates to a merchandise shelving display and more particularly to an extendible merchandise shelving display having extendible shelves which may be quickly and easily extended or retracted to provide shelving space as required and to provide shelving space for stocking products that vary in dimension.

Heretofore in the art to which my invention relates, various types of extendible merchandise displays have been proposed to provide additional shelving space as required. Difficulties have been encountered with such prior art displays due to the fact that they are difficult to extend and retract once products are stocked on the shelves. This is especially true in situations where there is limited access to the shelves, such as in refrigerated coolers and cases. Also, difficulties have been encountered in supporting and locking the shelves of such prior art displays in their extended and retracted positions.

Other merchandise shelving displays with which I am familiar are disclosed in U.S. Pat. Nos. 3,093,094, 4,294,363 and 4,307,671.

SUMMARY OF THE INVENTION

In accordance with my present invention, I overcome the above and other difficulties by providing an extendible merchandise shelving display which is simple and sturdy of construction and includes extendible shelves which may be quickly and easily extended or retracted to provide additional shelving space as required and to provide space for stocking products that vary in dimension.

It is an object of my invention to provide an improved extendible shelving display having novel means for supporting and positively locking the shelves in their extended and retracted positions.

Another object of my invention is to provide an improved extendible merchandise display which permits easy cleaning of the shelves and permits easy checking of the shelves for stock rotation.

Yet another object of my invention is to provide an improved extendible merchandise display which is attractive in appearance and eliminates cluttered arrangements of stock items whereby better impulse buying is promoted especially during various times of the year when products such as cookies, candy, potato chips and the like are in greater demand.

My improved extendible merchandise shelving display comprises at least one elongated, stationary shelf support which extends laterally from and is connected to at least one vertical support. An elongated, movable shelf support extends alongside and is slidably connected to the stationary shelf support. The movable shelf support is adapted for sliding movement relative to the stationary shelf support selectively to an extended position with the rear end of the movable shelf support being spaced from the vertical support and to a retracted position with the rear end of the movable shelf support being adjacent the vertical support. Cooperating locking members are carried by the movable shelf support and the stationary shelf support in position to engage each other and limit sliding movement of tho movable shelf support while in the extended and retracted positions. An extendible shelf embodying a shelf-like member carried by the movable shelf support and at least two movable shelf-like elements carried by the stationary shelf support form a generally horizontal, article supporting surface upon sliding movement of the movable shelf support to its extended position. The movable shelf-like elements are adapted to move to generally upstanding positions adjacent the vertical support upon sliding movement of the movable shelf support to its retracted position.

DESCRIPTION OF THE DRAWINGS

Extendible merchandise shelving displays embodying features of my invention are illustrated in the accompanying drawings, forming a part of this application, in which:

FIG. 8 is an enlarged, fragmental perspecitve view showing a wire-like connector detachably connecting the wire-like grid shelf to the movable shelf support;

FIG. 9 is an enlarged perspective view of the elongated wire-like connector shown in FIG. 8;

FIG. 10 is an enlarged, fragmental perspective view corresponding to FIG. 8 showing another form of connector for detachably connecting the wire-like shelf to the movable support;

FIG. 11 is an enlarged perspective view of the connector shown in FIG. 10;

FIG. 12 is a perspective view showing another modification wherein two extendible shelves are assembled alongside each other; and, FIG. 13 is an enlarged sectional view taken generally along the line 13—13 of FIG. 12.

DETAILED DESCRIPTION

Figure 1:
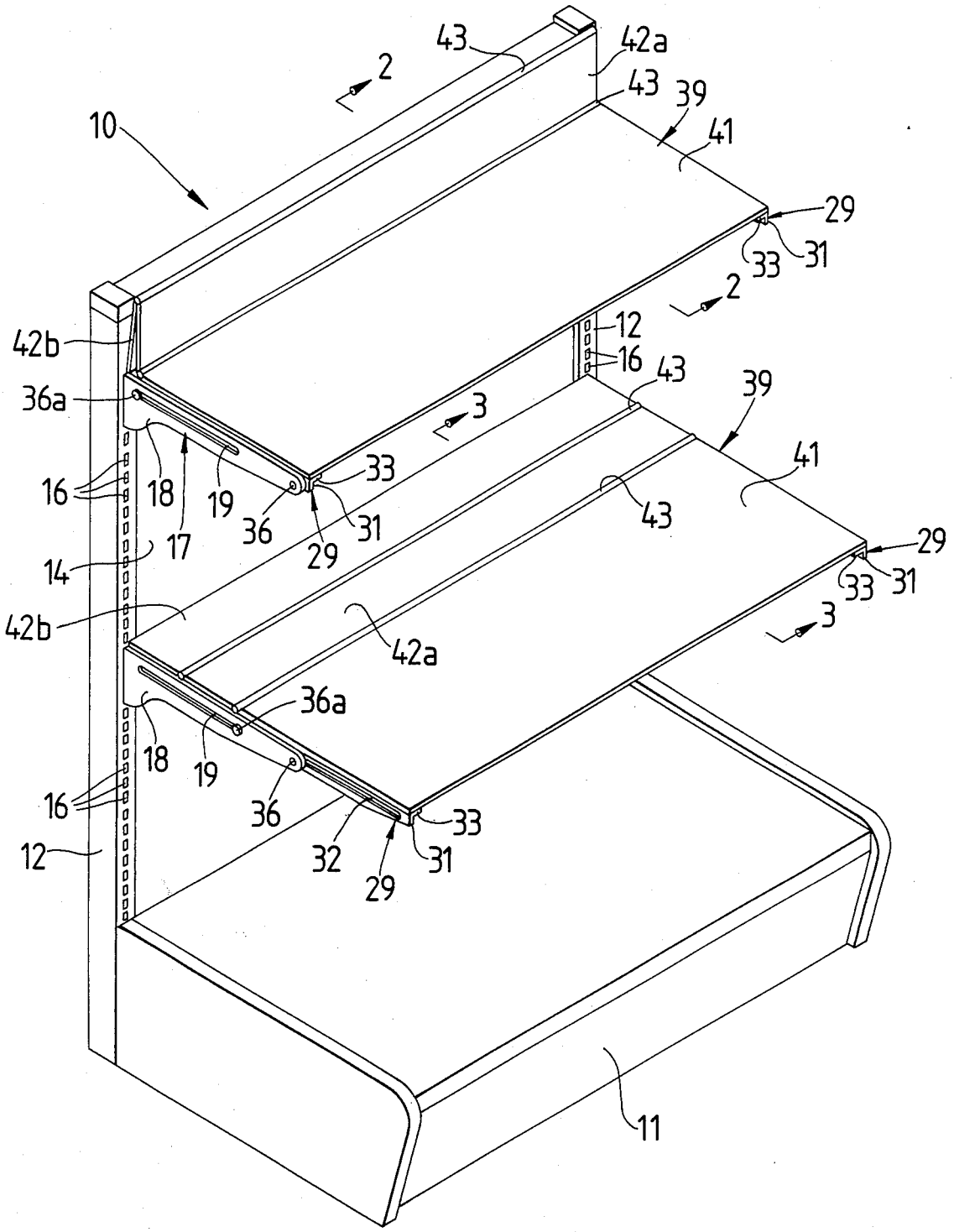
FIG. 1 is a perspective view showing my improved extendible merchandise display with the uppermost panel-like extendible shelf in its retracted position and with the lowermost panel-like extendible shelf in its extended position.

Referring now to the drawings for a better understanding of my invention, I show in FIG. 1 an extendible merchandise shelving display stand indicated generally at 10 and comprising a base 11 secured at its rear side to vertical supports 12. The vertical supports 12 are shown as being spaced from each other and connected to the opposite ends of a vertical back plate 14. Each vertical support 12 is provided with a plurality of equally spaced, vertically elongated slots 16, as shown. Extendible shelf supports, indicated generally at 17, are detachably connected to the vertical supports 12 in a manner to be described below.

Figure 2:
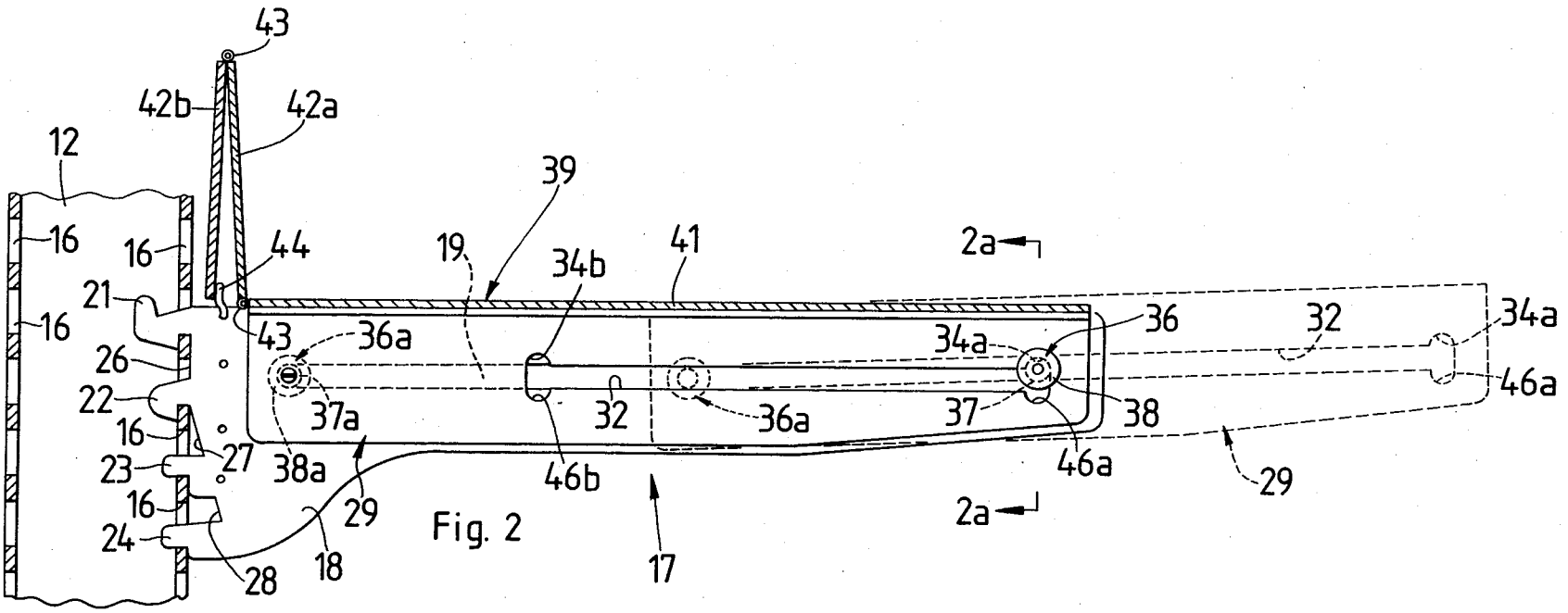
FIG. 2 is an enlarged sectional view taken generally along the line 2—2 of FIG. 1.
Figure 3:
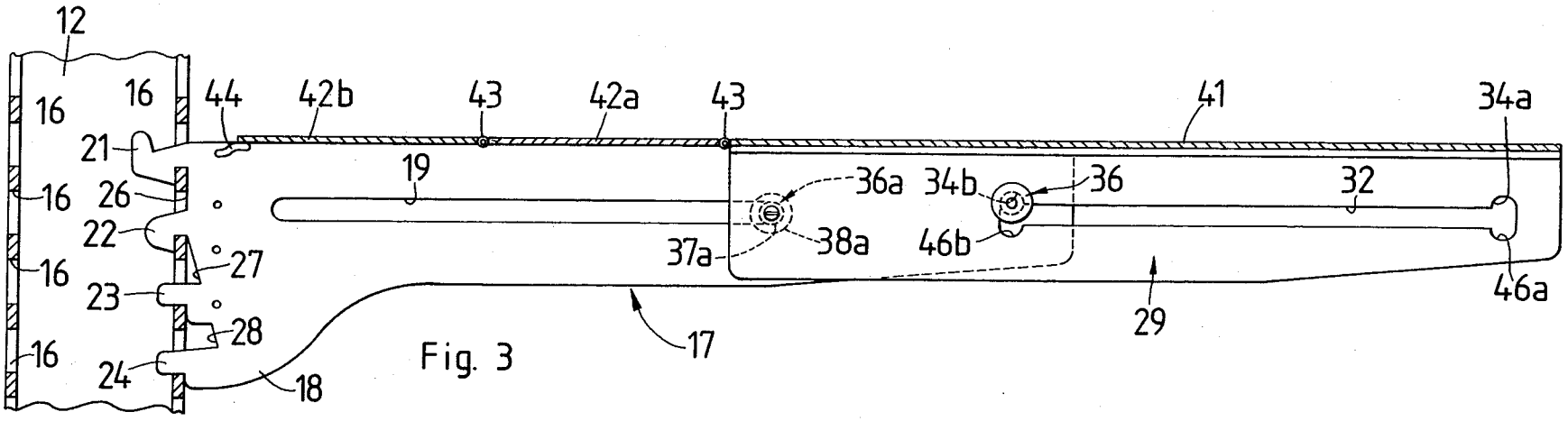
FIG. 3 is an enlarged sectional view taken generally along the line 3—3 of FIG. 1 showing the extendible shelf in its extended position.

As shown in FIGS. 1, 2 and 3, each shelf support 17 comprises an elongated, stationary shelf support 18 having a longitudinally extending slot 19 therethrough. The rear edge of each stationary shelf support 18 is provided with a pair of vertically spaced upper extensions 21 and 22 and a pair of vertically spaced lower extensions 23 and 24. As shown in FIGS. 2 and 3, the upper and lower extensions fit into the vertically spaced slots 16 to detachably connect the stationary shelf support 18 to its associated vertical support 12 in a manner well understood in the art to which my invention relates. The rear edge of each shelf support 18 is also provided with an abutting surface 26 between the upper extensions 21 and 22 for engaging the adjacent surface of its vertical support 12 when in a horizontal position, as shown. When it is desirable to move the shelf support 17 to a tilted position downwardly and forwardly of the vertical supports 12, abutting surfaces 27 and 28 are provided on the rear edge of the stationary shelf support 18 between the upper extension 22 and the lower extension 23 and between the lower extensions 23 and 24, respectively, to engage the adjacent surfaces of the vertical support 12 in the usual manner.

As shown in FIGS. 1–3, a movable shelf support 29 extends alongside and is slidably connected to the inside vertical surface of the stationary shelf support 18. The movable shelf support 29 is shown as being in the form of an angle member having a vertical flange 31 with a longitudinally extending slot 32 therethrough and a horizontal, inwardly extending flange 33.

Figure 2A:
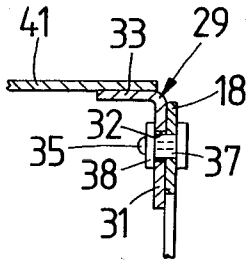
FIG. 2A is a sectional view taken generally along the line 2A—2A of FIG. 2.

As shown in FIGS. 2 and 3, the slot 32 is substantially aligned with the slot 19 in the stationary shelf support 18 and includes a plurality of downwardly opening recesses 34*a* and 34*b* along its upper longitudinal edge. The slot 32 is adapted to receive a first guide member 36 which is carried by the front end portion of the stationary shelf support 18. As shown in FIG. 2A, the guide member 36 includes a laterally extending member 37 which is carried by the stationary shelf support 18 in an offset upward direction relative to the longitudinal center of the slot 19. The member 37 is detachably connected to the stationary shelf support 18 by a threaded retainer member 35. The member 37, which may be in the form of a roller, engages the upper longitudinal edge of the slot 32 to support the movable shelf support 29 as it slides from a retracted position shown in solid lines in FIG. 2 to an extended position as shown in FIG. 3. When the movable shelf support 29 is in its retracted position, the member 37 services as a detent which engages the recess 34*a* at the forwardmost end of the slot 32 and limits sliding movement of the movable shelf support 29. When the movable shelf support 29 is moved to its extended position shown in FIG. 3, the member 37 engages the recess 34*b* and limits sliding movement of the shelf support 29.

A disc-like member 38 of a diameter greater than the vertical height or width of the slot 32 is threadedly connected to the laterally extending member 37 as shown in FIG. 2A. The member 38, carried by the member 37, slidably connects one end of the movable shelf support 29 to the stationary shelf support 18.

As shown in FIGS. 2 and 3, a second guide member 36*a* is carried by the rear end portion of the movable shelf support 29 in position to engage the slot 19 in the stationary shelf support 18. The guide member 36*a* is identical in structure to the guide member 36 and slidably connects the rear end of the movable shelf support 29 to the stationary shelf support 18. When the movable shelf support 29 is moved from its retracted position to its extended position, its front end portion must be lifted upwardly to disengage the member 37 from the notch 34*a*. This aligns the member 37 with the slot 32 in the movable support 29 and causes a laterally extending member 37*a* of the second guide member 36*a* to engage the lower longitudinal edge of the slot 19. As the movable shelf support 29 slides relative to the stationary shelf support 18, the member 37 remains in engagement with the slot 32 in the movable shelf support until it engages the notch 34*b*. When this occurs, the member 37*a* moves in an upward direction into engagement with the upper longitudinal edge of the slot 19. The engagement of the member 37 with its cooperating notch 34*b* and member 37*a* with the upper longitudinal edge of the slot 19 positively locks the movable support 29 in the extended position and causes the movable support 29 to move downwardly from a slightly upwardly tilted position to a generally horizontal position.

As shown in FIG. 1, an extendible shelf indicated generally at 39 is carried by each pair of extendible shelf supports 17. Each extendible shelf 39 is shown as including a panel-like shelf member 41 and at least two movable panel-like shelf elements 42*a* and 42*b*. The shelf member 41 extends between and is carried by the flanges 33 of the movable shelf supports 29 and may be attached thereto by suitable means such as by tack welding. The rear longitudinal edge of the shelf member 41 is pivotally connected by conventional means, such as by a piano hinge indicated at 43, to the adjacent longitudinal edge of the shelf element 42*a*. The shelf elements 42*a* and 42*b* are also pivotally connected to each other along adjacent longitudinal edges by conventional hinge means 43. The rear longitudinal edge of the shelf element 42*b* is pivotally connected, as at 44, to the rear end portion of the stationary shelf support 18, as shown in FIGS. 2 and 3. When the movable shelf supports 29 of each extendible shelf 39 are in their retracted positions, the shelf elements 42*a* and 42*b* are pivoted to generally upstanding positions adjacent the vertical support 12, as shown. Upon movement of the shelf supports 29 and the extendible shelf 39 carried thereby to an extended position, the shelf elements 42*a* and 42*b* pivot to a generally horizontal, article supporting position in alignment with the shelf member 41, as shown in FIG. 3. In this position the shelf elements 42*a* and 42*b* are supported by the stationary shelf support 18, which acts as a downward stop.

In FIGS. 2 and 3, I show upwardly opening recesses 46*a* and 46*b* along the lower longitudinal edge of the slot 32. The recesses 46*a* and 46*b* are vertically aligned with the recesses 34*a* and 34*b*, respectively. When it is desired to mount the extendible shelf 39 in a position adjacent the lower longitudinal edge of the stationary shelf support 18, the recesses 46*a* and 46*b* engage the guide member 36 and lock the movable shelf supports 29 in their retracted and extended positions, respectively. That is, when the shelf-like member 41 and shelf-like elements 42*a* and 42*b* are supported along the lower longitudinal edge of the stationary shelf supports 18, each movable shelf support 29 must be disconnected from its stationary shelf support 18 and reconnected to the stationary shelf support 18 at the opposite side of the extendible shelf 19 in an inverted position. In this position the flanges 33 of the movable supports 29 extend inwardly toward each other and are adjacent the lower longitudinal edges of the stationary supports 18. The recesses 46*a* thus engage the guide members 36 when the movable shelf supports 29 are in their retracted positions and the recesses 46*b* engage the guide members 36 when the movable shelf supports are in their extended positions.

Figure 4:
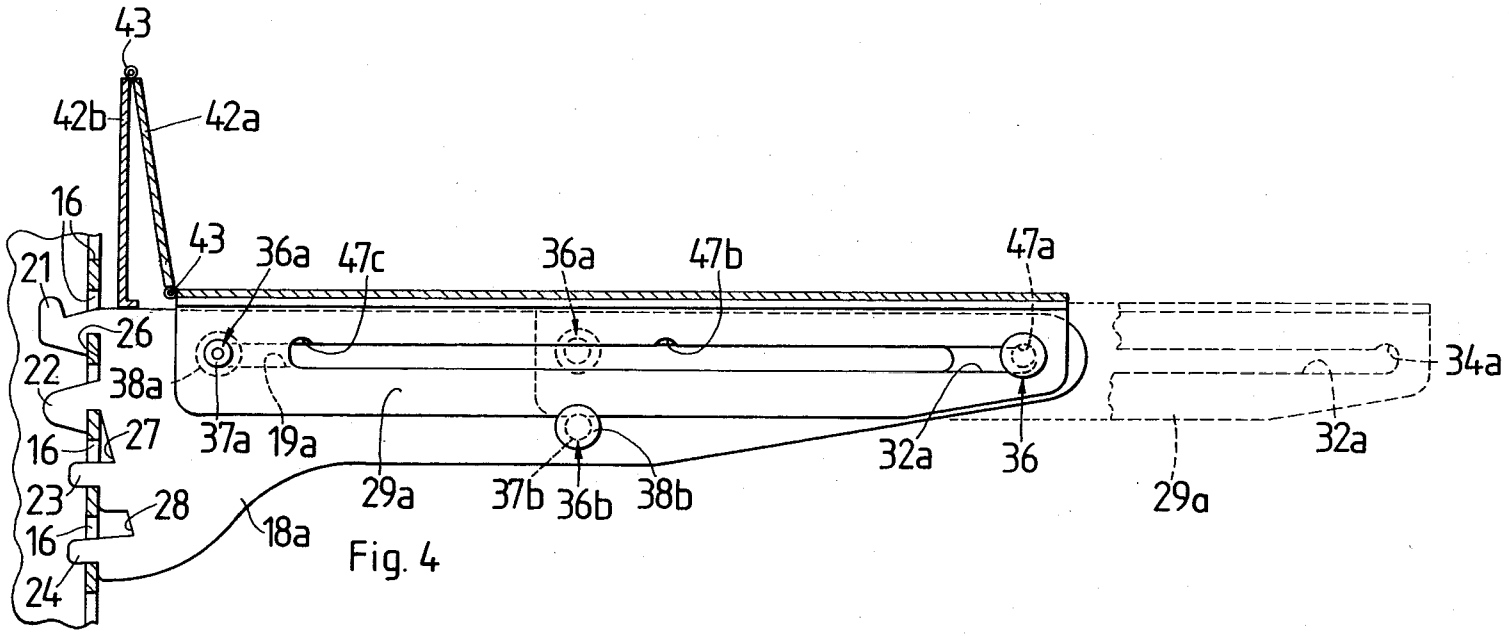
FIG. 4 is a sectional view corresponding to FIG. 2 showing a modified form of my invention with the extendible shelf in its retracted position in solid lines and in an intermediate extended position in dotted lines.
Figure 5:
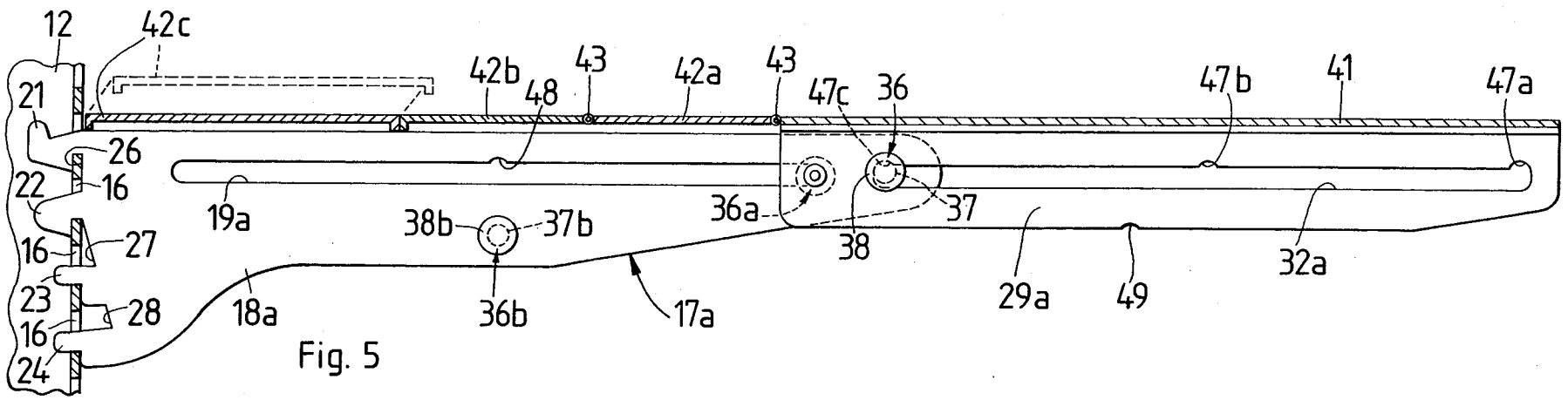
FIG. 5 is a sectional view corresponding to FIG. 4 showing the extendible shelf in its fully extended position.

Referring now to FIGS. 4 and 5, I show a modified form of my invention in which an extendible shelf support 17*a* is detachably connected to the vertical support 12. The shelf support 17*a* is adapted to extend selectively from a retracted position shown in solid lines in FIG. 4, to an intermediate extended position shown in FIG. 4 and then to a fully extended position shown in FIG. 5. The extendible shelf support 17*a* includes a movable shelf support 29*a* having a longitudinally extending slot 32*a* therethrough. The slot 32*a* is provided with a plurality of downwardly opening recesses 47*a*, 47*b* and 47*c*. When the movable shelf support 29*a* is in its retracted position, a first guide member 36 carried by the front end portion of a stationary shelf support 18*a* engages the recess 47*a* and limits sliding movement of the movable shelf support 29*a*. When the movable shelf support 29*a* is moved to its intermediate extended position, the guide member 36 engages the downwardly opening recess 47*b* and a second guide member 36*a* carried by the rear end portion of the movable shelf support 29*a* engages a downwardly opening recess 48 in the upper longitudinal edge of a longitudinally extending slot 19*a* in the stationary shelf support 18*a*. Upon sliding movement of the movable shelf support 29*a* to its fully extended position, the first guide member 36 engages the downwardly opening slot 47*c*, as shown in FIG. 5.

A guide member 36*b* having a laterally extending member 37*b* and a disc-like member 38*b* may also be carried by the stationary shelf support 18*a* in position to engage and support the lower longitudinal edge of the movable shelf support 29*a* while in the retracted position. That is, a downwardly opening recess 49 may be provided along the lower longitudinal edge of the movable support 29*a* in position to engage the guide member 36*b* upon sliding movement of the movable shelf support 29*a* to its retracted position.

As shown in FIG. 5, when the movable shelf support 29*a* is in its fully extended position, a panel-like shelf element 42*c* may be placed behind the shelf element 42*b* to complete the article supporting surface above the stationary shelf supports 18*a*. While I have shown the shelf element 42*c* as being inserted in place, it will be apparent that it may be pivotally connected to the rear longitudinal edge of the shelf element 42*b*.

Figure 6:
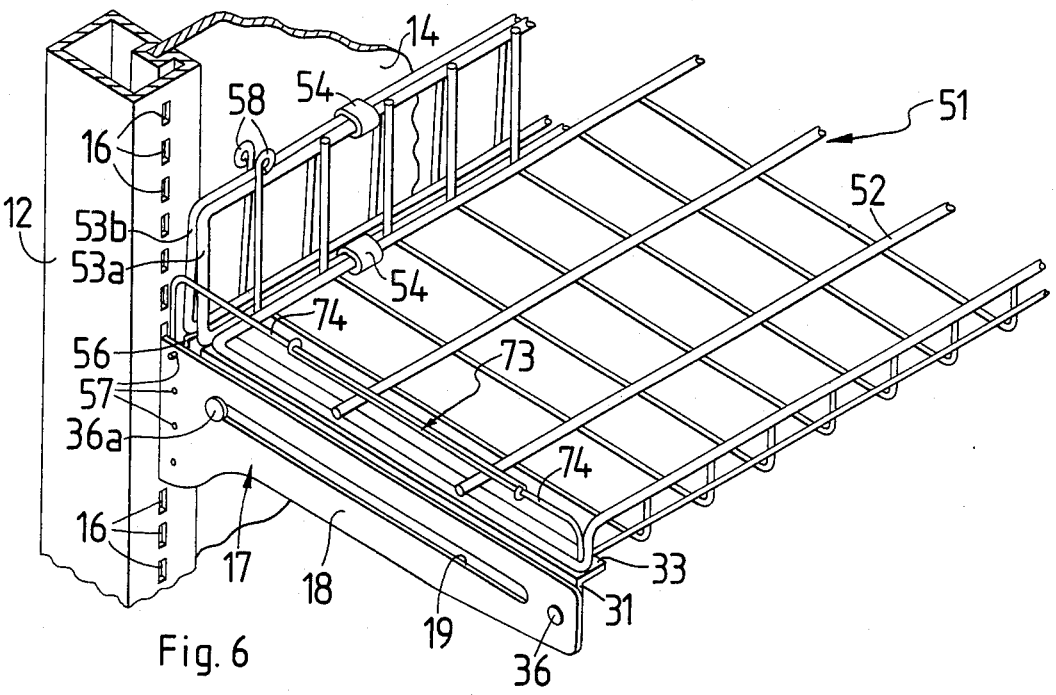
FIG. 6 is a fragmental, perspective view showing another modified form of my invention wherein a wire-like grid extendible section is shown in its retracted position.
Figure 7:
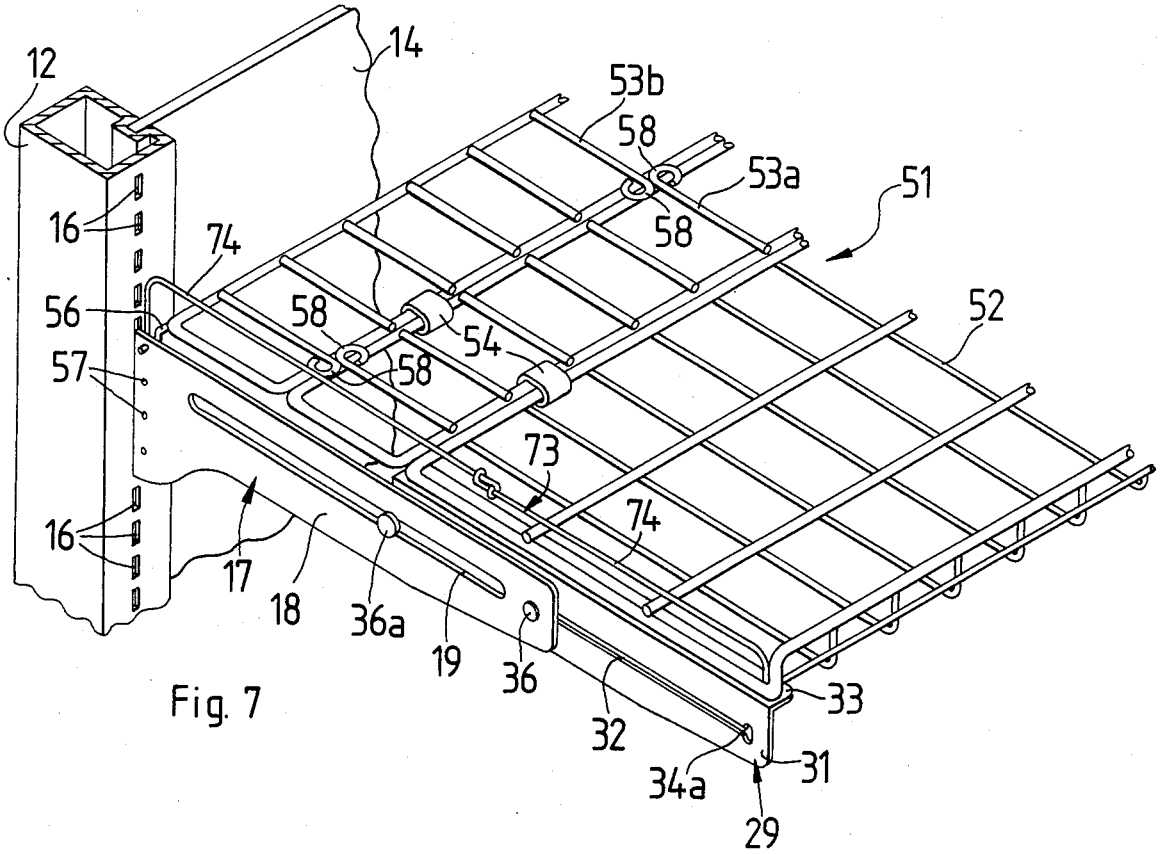
FIG. 7 is a fragmental perspective view corresponding to FIG. 6 showing the wire-like grid extendible shelf in its extended position.

Referring now to FIGS. 6 and 7, I show another modified form of my invention in which a wire-like grid extendible shelf 51 is carried by the extendible shelf support 17. The extendible shelf 51 includes a wire-like grid shelf member 52 and at least two movable wire-like grid shelf elements 53*a* and 53*b*. The wire grid shelf member 52 is carried by the movable support 29 and includes conventionally formed clip or hinge members 54 along its rear longitudinal edge which pivotally connect the shelf member 52 to the shelf element 53*a*. As shown in FIGS. 6 and 7, hinge members 54 are also used to pivotally connect adjacent longitudinal edges of the shelf elements 53*a* and 53*b* to each other. An offset wire member 56 is carried by the rear longitudinal edge of the shelf element 53*b* in position to enter an opening 57 in the shelf support 18 for pivotally connecting the shelf element 53*b* thereto. A plurality of vertically spaced openings 57 may be provided through the stationary shelf support 18 for receiving one end of the offset wire member 56 whereby the extendible shelf 51 may be pivotally connected at selected elevations relative to the stationary shelf support 18. The shelf elements 53*a* and 53*b* are thus adapted for pivotal movement to a generally horizontal, article supporting position in alignment with the shelf element 53 upon sliding movement of the movable shelf support 29 to its extended position, as shown in FIG. 7. The shelf elements 53*a* and 53*b* are also adapted to pivot to generally upstanding positions adjacent the vertical support 12 upon pivotal movement of the movable shelf support 29 to its retracted position, as shown in FIG. 6.

A plurality of pairs of oppositely disposed braces 58 are carried by the adjacent longitudinal edges of the shelf elements 53*a* and 53*b*, as shown in FIGS. 6 and 7. Each brace 58 is adapted to extend transversely across the adjacent longitudinal edges of the shelf elements 53*a* and 53*b* and engage an adjacent portion of the other shelf element upon pivotal movement of the shelf elements to a generally horizontal article supporting position. The braces 58 thus limit downward pivotal movement of the shelf elements 53*a* and 53*b* when in the generally horizontal, article supporting position.

In FIGS. 8–11, I show two forms of connector members which may be used to detachably connect the wire grid shelf member 52 to the movable supports 29. FIGS. 8 and 10 show a plurality of elongated slots 59 and openings 61 through the flange 33 of the movable shelf support 29. FIGS. 8 and 9 show an elongated wire-like connector 62 which is adapted to extend alongside an end portion of an adjacent wire-like member 63 of the wire-like grid shelf member 52. One end portion 64 of the wire-like connector 62 is adapted to extend upwardly through an adjacent elongated slot 59 in the flange 33 and at least partially encircle the adjacent end portion of the wire-like member 63 between the elongated slot 59 and the opening 61. As shown in FIG. 8, the end portion 64 of the wire-like connector 62 terminates inwardly of the opening 61 to limit sliding movement of the shelf element 52. The other end portion 66 of the connector 62 is adapted to partially encircle the wire-like member 63, as shown.

In FIGS. 10 and 11, I show an elongated connector 67 having oppositely disposed laterally opening notches 68 at one end 69. The end 69 of the connector 67 is adapted to be inserted into the slot 59 and then rotated 90° whereupon the notches 68 engage the sides of the slot 59. The connector 67 is then bent downwardly whereupon the mid portion of the connector partially encircles the end portion of the wire-like member 63 as shown. An opening 71 is provided through the other end of the connector 67 in alignment with the opening 61 in the flange 33 for receiving a retainer member 72.

As shown in FIGS. 6 and 7, an extendible bracket 73 extends along each end of the extendible shelf 51 to prevent articles supported on the shelf from falling off. Each bracket 73 includes a pair of longitudinally extending wire-like members 74 which are connected to each other for sliding movement relative to each other selectively to an extended position as shown in FIG. 7 and to a retracted position as shown in FIG. 6. That is, upon sliding movement of the movable shelf support 29 to its extended position the wire-like members 74 assume the extended position, as shown in FIG. 7. When the movable shelf support 29 slides to its retracted position, the wire-like members 74 assume the retracted position, as shown in FIG. 6.

Referring now to FIGS. 12 and 13, I show another modified form of my invention wherein two side-by-side extendible panel-like shelves 39 are supported by three spaced apart vertical supports 12. The stationary shelf support 18*b* for this embodiment is provided with an elongated laterally opening recess 76 in the side of the stationary shelf support 18*b* opposite the side thereof adjacent the movable support 29, as shown in FIG. 13. The laterally opening recesses 76 thus face each other and permit two sationary shelf supports 18*b* to extend alongside each other as shown in FIG. 13. With this arrangement, the disc-like members 38*a* of the second guide members 36*a* extending through the slots 19 in the stationary shelf supports 18*b* move longitudinally within their respective elongated recesses 76 without interference with each other.

From the foregoing description, the operation of my improved extendible merchandising shelving display will be readily understood. With either of the extendible shelves 39 or 51 mounted on the extendible shelf support 17 and with the extendible shelf being in its retracted position, the shelf is moved to its extended position by lifting the front end of the movable shelf support 29, as shown in FIG. 2. This disengages the first guide member 36 from its cooperating downwardly opening recess 34*a* and aligns the member 37 of the first guide member 36 with the longitudinally extending slot 32 in the movable shelf support 29. The movable shelf support 29 may then be moved outwardly toward its extended position where the guide member 36 engages the downwardly opening recess 34*b*. The engagement of the guide member 36 with the recess 34*b* positively locks the extendible shelf and movable shelf support 29 in their extended positions, as shown in FIG. 3. As the movable shelf support 29 moves outwardly toward its extended position, the movable shelf elements 42*a*, 42*b* or 53*a*, 53*b*, as the case may be, pivot downwardly from their generally upstanding positions adjacent the vertical support 12 to a generally horizontal article supporting position behind the shelf member 41 or 52, as the case may be. If a three position extendible shelf support 17*a* is employed, a third movable shelf element 42*c* may be placed behind the shelf element 42*b* to complete the article supporting surface, as shown in FIG. 5. To move the extendible shelf 39 or 51, as the case may be, from the extended position to the retracted position, the front end of the movable shelf support 29 is again lifted, as shown in FIG. 2. This disengages the guide members 36 from the downwardly opening recesses 34*b* and permits the movable shelf supports to slide rearwardly toward the vertical support 12. As the movable shelf supports 29 move rearwardly toward the vertical support 12, the movable shelf elements 42*a*, 42*b* or 53*a*, 53*b*, as the case may be, pivot upwardly to generally upstanding positions, as shown in FIGS. 2 and 6. Upon sliding movement of the movable shelf supports 29 to their retracted positions, the guide members 36 engage the downwardly opening recesses 34*a* and positively lock the movable shelf supports and extendible shelf 39 or 51, as the case may be, in their retracted positions.

From the foregoing, it will be seen that I have devised an improved extendible merchandise shelving display that is simple and durable of construction and one which may be quickly and easily extended or retracted to selected positions whereby the shelf may provide increased or decreased shelving space as required. Also, by providing extendible shelf supports which may be positively locked in selected retracted or extended positions, I prevent unwanted movement of the extendible shelf while in use. Furthermore, to move the extendible shelf from its retracted position to its extended position or vice versa, one merely exerts a slight upward push at the front end of the shelf and pulls the shelf outwardly to extend the shelf or pushes the shelf inwardly to retract it.

While I have shown my improved extendible shelf as being supported by two or more spaced apart vertical supports, it will be apparent that the extendible shelf may be supported by one or more vertical supports.

While I have shown my invention in several forms, it will be obvious to those skilled in the art that it is not so limited but is susceptible of various other changes or modifications without departing from the spirit thereof.

What I claim is:

1. An extendible merchandise shelving display comprising, (a) at least one vertical support, (b) at least one elongated, stationary shelf support having means for connecting said stationary support to said vertical support, (c) an elongated, movable shelf support extending alongside and slidably connected to said stationary support for sliding movement relative to said stationary support selectively to an extended position with the rear end of said movable support being spaced from said vertical support and to a retracted position with said rear end being adjacent said vertical support wherein a longitudinally extending slot is provided through said movable support in position to receive a first guide member carried by the front end portion of said stationary support and a longitudinally extending slot is provided through said stationary support in position to receive a second guide member carried by the rear end portion of said movable support, (d) means carried by said movable support and said stationary support and adapted to cooperate with each other to limit sliding movement of said movable support while in said extended position and while in said retracted position, there being a downwardly opening recess at the forwardmost end of said longitudinally extending slot in said movable support in position to engage said first guide member upon sliding movement of said movable support to said retracted position, and there being a downwardly opening recess at the rearmost end of said longitudinally extending slot in said movable support in position to engage said first guide member upon sliding movement of said movable support to said extended position, (e) a shelf-like member carried by said movable support, (f) at least two movable shelf-like elements carried by said stationary support and pivotally connected to each other along adjacent longitudinal edges with the other longitudinal edge of one shelf-like element being pivotally connected to the rear longitudinal edge of said shelf-like member and with the other longitudinal edge of the other shelf-like element being pivotally connected to said stationary support with said shelf-like element being adapted for pivotal movement selectively to a generally horizontal, article supporting position upon sliding movement of said movable support to said extended position and to generally upstanding positions adjacent said vertical support upon sliding movement of said movable support to said retracted position, and (g) stop means limiting downward pivotal movement of said shelf-like elements while in said generally horizontal position.

2. An extendible merchandising shelving display as defined in claim 1 in which said first guide member carried by said front end portion of said stationary support is offset in an upward direction relative to the longitudinal center of said longitudinally extending slot in said stationary support so that said downwardly opening recesses in said movable support positively engage said first guide member to limit sliding movement of said movable support while in said extended and retracted positions.

3. An extendible merchandising shelving display comprising, (a) at least one vertical support, (b) at least one elongated, stationary shelf support having means for connecting said stationary support to said vertical support, (c) an elongated, movable shelf support extending alongside and slidably connected to said stationary support for sliding movement relative to said stationary support selectively to an extended position with the rear end of said movable support being spaced from said vertical support and to a retracted position with said rear end being adjacent said vertical support, (d) means carried by said movable support and said stationary support and adapted to cooperate with each other to limit sliding movement of said movable support while in said extended position and while in said retracted position, (e) a shelf-like member carried by said movable support, said shelf-like member being a wire-like grid member, (f) at least two movable shelf-like elements carried by said stationary support and pivotally connected to each other along adjacent longitudinal edges with the other longitudinal edge of one shelf-like element being pivotally connected to the rear longitudinal edge of said shelf-like member and with the other longitudinal edge of the other shelf-like element being pivotally connected to said stationary support with each of said shelf-like elements being adapted for pivotal movement selectively to a generally horizontal, article supporting position upon sliding movement of said movable support to said extended position and to a generally upstanding position adjacent said vertical support upon sliding movement of said movable support to said retracted position, each of said shelf-like elements being wire-like grid members, (g) stop means limiting downward pivotal movement of each said shelf-like element while in said generally horizontal position, and (h) connector means detachably connecting the wire-like grid member carried by said movable support to said movable support including a laterally extending flange carried by the side of said movable support opposite the side thereof adjacent said stationary support, there being at least one elongated slot through said flange, there being at least one opening through said flange longitudinally spaced from one end of said elongated slot, an elongated wire-like connector adapted to extend alongside the end portion of an adjacent wire-like member with one end portion of said connector being adapted to extend upwardly through said slot and at least partially encircle an adjacent end portion of a wire-like member between said elongated slot and said opening with said one end portion of said connector terminating inwardly of said opening, and the other end of said connector being adapted to partially encircle said wire-like member.

* * * * *